US009263247B2

(12) United States Patent
Heil et al.

(10) Patent No.: US 9,263,247 B2
(45) Date of Patent: Feb. 16, 2016

(54) ELECTRIC LAMP AND ASSOCIATED PRODUCTION METHOD

(71) Applicant: OSRAM GmbH, München (DE)

(72) Inventors: Thomas Heil, Schernfeld (DE); Heinz Lang, Schernfeld (DE); Roland Stark, Welheim (DE); Georg Rosenbauer, Wassertrudingen (DE)

(73) Assignee: OSRAM GmbH, Munich (DE)

( * ) Notice: Subject to any disclaimer, the term of this patent is extended or adjusted under 35 U.S.C. 154(b) by 0 days.

(21) Appl. No.: 14/327,586

(22) Filed: Jul. 10, 2014

(65) Prior Publication Data

US 2015/0048734 A1 Feb. 19, 2015

(30) Foreign Application Priority Data

Aug. 16, 2013 (DE) ..... 20 2013 007 411 U

(51) Int. Cl.

| | |
|---|---|
| ***H01K 1/38*** | (2006.01) |
| ***H01K 1/18*** | (2006.01) |
| ***H01K 1/46*** | (2006.01) |
| ***H01K 1/20*** | (2006.01) |
| *H01K 1/34* | (2006.01) |

(52) U.S. Cl.

CPC .. *H01K 1/38* (2013.01); *H01K 1/20* (2013.01); *H01K 1/46* (2013.01); *H01K 1/18* (2013.01); *H01K 1/34* (2013.01)

(58) Field of Classification Search

CPC ..... H01K 1/18–1/24; H01K 1/38–1/48

USPC ..... 313/623, 271–279, 315

See application file for complete search history.

(56) References Cited

U.S. PATENT DOCUMENTS

| | | | | |
|---|---|---|---|---|
| 4,717,852 | A | 1/1988 | Dobrusskin et al. | |
| 5,367,220 | A * | 11/1994 | Stadler et al. | 313/578 |
| 2003/0132708 | A1 * | 7/2003 | Kuti et al. | 313/578 |

FOREIGN PATENT DOCUMENTS

| | | | |
|---|---|---|---|
| DE | 3232207 | A1 | 3/1984 |
| DE | 102008028383 | A1 | 12/2009 |

* cited by examiner

*Primary Examiner* — Mariceli Santiago

(74) *Attorney, Agent, or Firm* — Viering, Jentschura & Partner mbB

(57) ABSTRACT

In various embodiments, a lamp has a bulb with a pinch seal, which holds a light-emitting element by means of a wire clip. The wire clip consists of tungsten and has, at an end remote from films embedded in the pinch seal, an eyelet for holding the light-emitting element. An end of the wire clip which is close to a film is bent back. A film associated with the wire clip is folded in a roof-shaped manner. Overall, it is thus possible to realize a lamp with a long life.

8 Claims, 5 Drawing Sheets

ELECTRIC LAMP AND ASSOCIATED PRODUCTION METHOD

CROSS-REFERENCE TO RELATED APPLICATION

This application claims priority to German Utility Model Application Serial No. 20 2013 007 411.6 which was filed Aug. 16, 2013, and is incorporated herein by reference in its entirety.

TECHNICAL FIELD

The invention relates to an electric lamp having a longitudinal axis, wherein the lamp is provided with a pinch seal having two narrow sides and two broad sides, wherein the lamp has a bulb consisting of quartz glass with a pinch seal and films fitted therein, in which bulb a light-emitting element is held at the ends by a frame.

In addition, the invention relates to an electric lamp with a base at one end comprising an outer bulb held in a base and at least one built-in lamp arranged within the outer bulb. Such halogen incandescent lamps are envisaged in particular for operation at high voltages (HV) or medium voltages (MV), typically on a grid voltage of 100 to 250 V.

BACKGROUND

DE 10 2008 028 383 discloses a holder for a built-in lamp in an outer bulb, wherein the holder consists of molybdenum.

It is an object of the present invention to provide an electric lamp which has an extended life.

It is a further object of the present invention to specify a production method for such a lamp.

SUMMARY

The object of the present invention is achieved by means of an electric lamp having a longitudinal axis and a pinch seal, said pinch seal having two narrow sides and two broad sides, wherein the electric lamp has a bulb consisting of quartz glass equipped with said pinch seal and films fitted therein, in which bulb a light-emitting element is held at the ends of said light-emitting element by a frame, wherein the frame has at least one wire clip, which holds an end of the light-emitting element which is remote from the films, wherein the wire clip is manufactured at least partially from tungsten and is bent back at an angle at a film-side end of said wire clip, and wherein at least a film associated with the wire clip is folded in the form of a V along the longitudinal axis The further object of the present invention is achieved by means of a production method for the above-mentioned electric lamp, wherein an end of the light-emitting element remote from the films is introduced into an eyelet of the wire clip, which eyelet is formed by a coil, and then the eyelet is compressed, wherein, during the compression, the eyelet is heated by means of a passage of current sufficiently in order to enable plastic deformation of the eyelet, with the result that holding of the end is achieved by means of the compression.

BRIEF DESCRIPTION OF THE DRAWINGS

The invention will be explained in more detail below with reference to a plurality of exemplary embodiments. The drawings are not necessarily to scale, emphasis instead generally being placed upon illustrating the principles of the invention. In the following description, various embodiments of the invention are described with reference to the following drawings, in which.

DESCRIPTION

Figure 1:
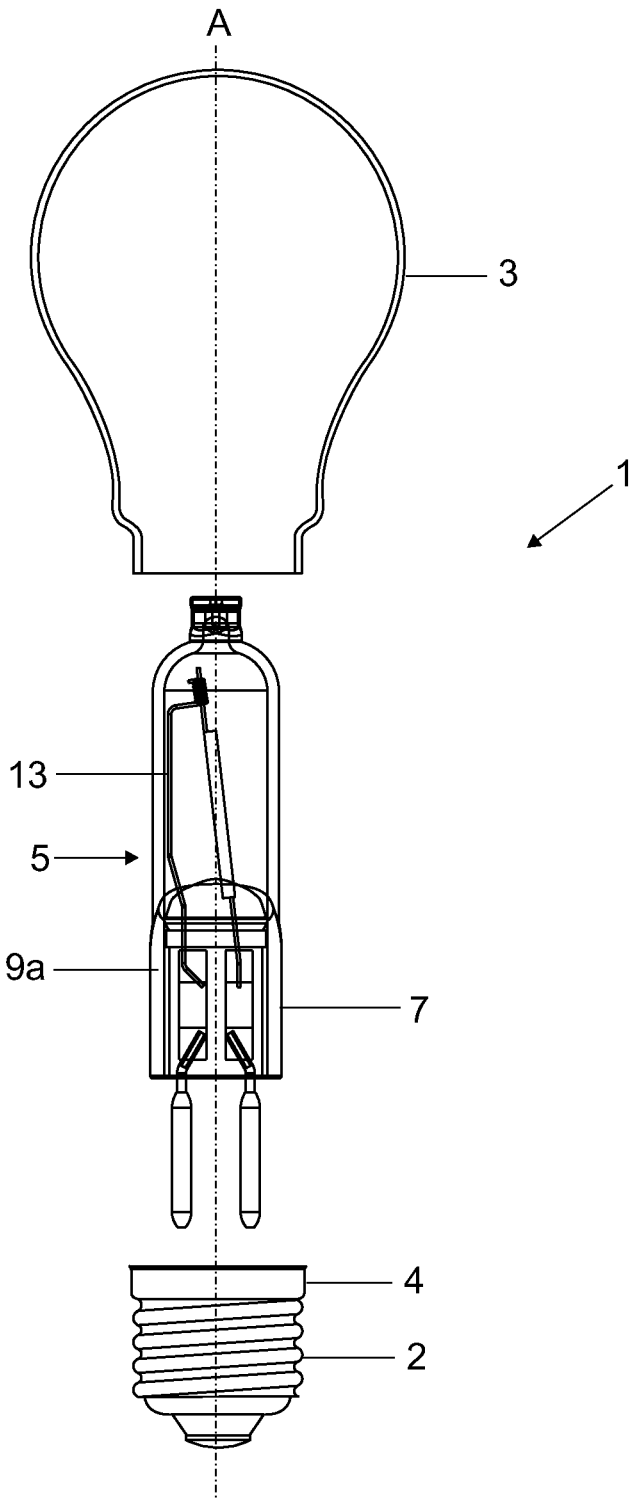
FIG. 1 shows a basic illustration of a lamp according to the invention in an exploded illustration.

The following detailed description refers to the accompanying drawings that show, by way of illustration, specific details and embodiments in which the invention may be practiced.

As a departure from a highly automated process, a novel assembly concept is now proposed which manages without any complex adjustment.

The invention ensures simple and reliable production of a lamp with a built-in lamp. The invention in particular provides an electric lamp with a base at one end comprising an outer bulb fastened to a base and a built-in lamp arranged within the outer bulb, which lamp can be produced in a robust and simple manner. Preferably, the lamp or built-in lamp is a high-voltage or medium-voltage halogen incandescent lamp, wherein at least two pins act as power supply wires. The built-in lamp has a bulb consisting of quartz glass with a pinch seal, which bulb holds a light-emitting element by means of a wire clip.

The lamp or built-in lamp substantially comprises a hermetically sealed lamp vessel or bulb with a pinch seal, at least one light-emitting element and a power supply system, which generally also has two outer power supply lines, which protrude axially parallel to one another out of the pinch seal. The light-emitting element is often connected to the outer power supply lines via inner power supply lines, of which the wire clip forms part, and films.

The power supply system connects the light-emitting element arranged in the interior of the lamp vessel to a base arranged outside the lamp vessel, which base is intended to be connected to a current source. The power supply system comprises, for example, inner power supply wires, fuse-seal films and outer power supply wires, wherein those ends of the inner and outer power supply wires which are aligned with one another and the fuse-seal films which connect the power supply wires to one another are fuse-sealed in the lamp pinch seal. The material of the inner power supply wires is relevant to the invention; this material should preferably be tungsten or material with a similarly high melting point to that of tungsten. The bulb is generally filled with an inert gas and a halogen additive. Instead of an incandescent lamp, it is also possible for a high-pressure discharge lamp to be used, in particular as built-in lamp, similar to that described in DE-A 32 32 207.

In order to achieve a long life, the holder parts of a halogen lamp comprising a bulb consisting of quartz glass are manufactured from tungsten. The basic concept of the present invention in this case consists in implementing fastening of filament to a frame holder consisting of tungsten, in particular with a coiled eyelet at one end. In the case of halogen lamps comprising a bulb consisting of hard glass, molybdenum is used as material for the holder parts.

A holder consisting of tungsten cannot be bent with as much process reliability as a holder consisting of molybdenum, however. This has prevented the use of tungsten as material to date. The present invention discloses for the first time a practical way of using the material tungsten appropriately and of adapting other properties of the lamp to match.

An important aid for safe application of a frame wire consisting of tungsten consists in at the same time also using molybdenum films which are folded in the form of a V and which are sealed in the quartz glass. This measure improves the stability of the frame until the time of fuse-sealing in the quartz glass bulb.

Advantageously, in this case the film-side end of the frame wire consisting of tungsten is bent back through approximately 45°. This is used for stabilizing the position of the holder during fuse-sealing in the pinch seal of the bulb.

Until now, filament fastening on a filament holder consisting of molybdenum has been achieved by virtue of said filament holder being flattened, then bent back and then the primary coil end of the filament being clamped in between the flattened holder parts which are then compressed. This technique cannot be used in the case of tungsten, however, since the material is too brittle.

In accordance with the invention, a stable filament fastening which has good manufacturing process reliability is achieved in that the following steps are taken into consideration in the production:

A coil, referred to further below as eyelet, is formed from approximately 4 to 8 turns at that end of the tungsten holder which is remote from the base. The turns of the coil should preferably rest one on the other, i.e. touch one another or be very close to one another. The inner diameter of the eyelet should preferably be approximately 0.2 mm greater than the primary coil of the filament. The filament is preferably a cc filament with sections comprising primary coil and secondary coil. The actual light-emitting element is in this case one or more sections with secondary coil, and the ends are sections with purely primary coil. However, it is also possible to use a filament which only has primary coil, wherein the ends are an uncoiled wire. The light-emitting element is preferably manufactured from tungsten.

The filament end is threaded through the coil of the eyelet and fixedly clamped by compression of the coil. During the compression of the coil, said coil is heated by the passage of current to such an extent that the tungsten wire does not split on compression. This measure represents a significant improvement for facilitating processing of tungsten.

In order that the position of the filament holder or frame wire does not change owing to the elastic stress of the light-emitting element as a result of the narrow molybdenum films which are not very flexurally rigid, said films are bent in advance in the form of a V.

By virtue of an end of the frame wire which is bent back on the film side, positionally correct pinch-sealing of the frame wire in the pinch seal of the bulb is ensured.

An advantage of the invention is considered in particular to be that the use of filament holders consisting of tungsten enables an extension of the life of the order of magnitude of at least 10%.

Additional advantages are the process reliability of the filament assembly and, despite the poor machineability of tungsten wires, stable holding of the filaments. Therefore, for the first time positionally correct pinch-sealing of the holder in the quartz bulb is achieved.

FIG. 1 shows a complete halogen incandescent lamp 1. An outer bulb 3 is held by means of cement in a base sleeve 4 in a base 2 of a conventional type, such as a bayonet base or screw base E14 or E27. A built-in lamp 5 is arranged within the outer bulb 3. The built-in lamp is in the form of a so-called high-voltage halogen incandescent lamp and is known in principle from the prior art. The lamp 1 has a longitudinal axis A, on which the built-in lamp is also aligned.

Figure 2A:
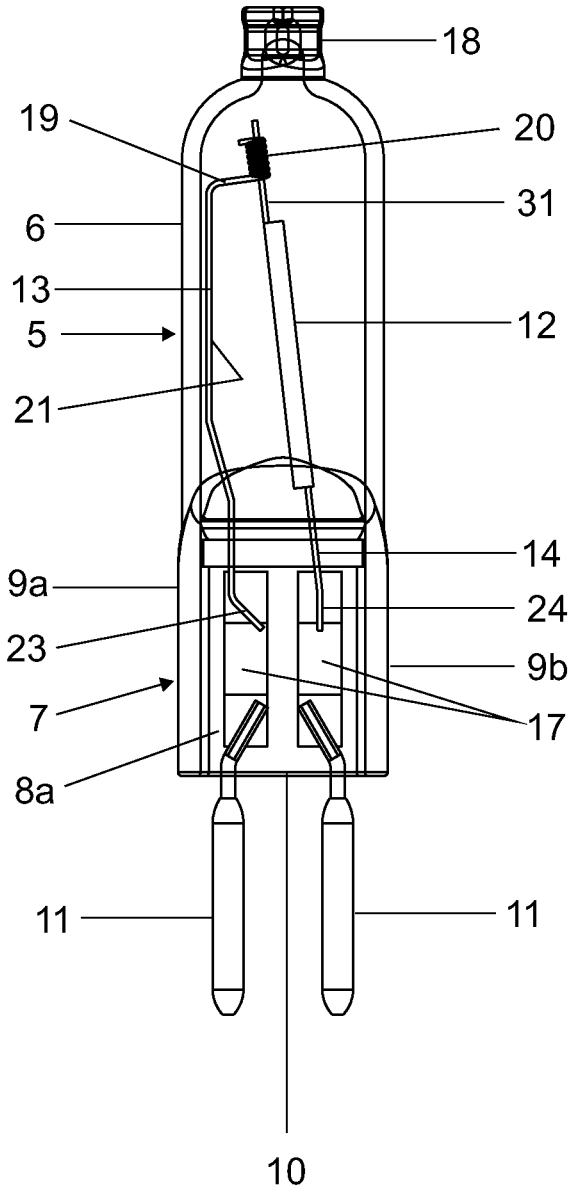
FIG. 2A shows a view of a built-in lamp in detail.
Figure 2B:
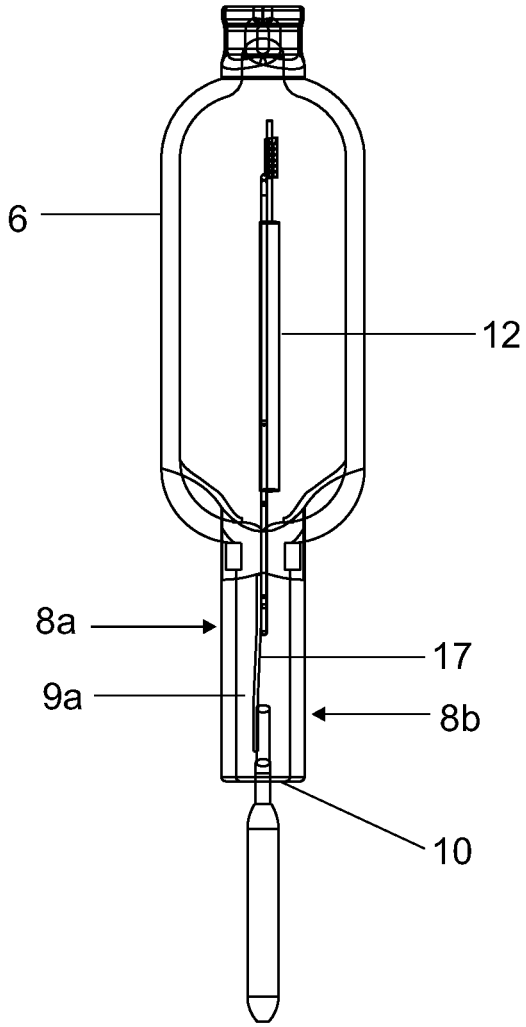
FIG. 2B shows another view of the built-in lamp of FIG. 2A rotated through 90°.

The built-in lamp 5 (see also FIGS. 2A and 2B) is provided with a single pinch seal 7, which has two broad sides 8*a* and 8*b* and two narrow sides 9*a* and 9*b* and a bottom part 10. Pin-like outer power supply lines 11 protrude out of the pinch seal 7.

The built-in lamp 5 is, for example, a halogen incandescent lamp which is pinch-sealed at one end and comprises a lamp vessel 6, in which a light-emitting element 12 is fixed. The light-emitting element 12 is electrically conductively connected to the base 2 via a power supply system. The power supply system comprises, connected to the light-emitting element 12, inner power supply wires, fuse-seal films 17 and outer power supply wires 11. In this case, a first inner power supply wire is formed by a long wire clip 13, which is aligned substantially parallel to the longitudinal axis and is manufactured from tungsten. The second inner power supply line 14 is formed directly by the film-side end 14, 24 of the light-emitting element 12, which film-side end has a single-coil filament, wherein said light-emitting element 12 is likewise manufactured from tungsten. This end is a single-coil filament (sc).

Those ends 23, 24 of the inner power supply wires 13 and 14 which are remote from the light-emitting element 12, the fuse-seal films 17 and those ends of the outer power supply wires 11 which face the fuse-seal films 17 are fuse-sealed in the pinch seal 7, which closes off the lamp vessel 6.

The lamp vessel 6 is filled with an inert gas and halogen additive. At its end 18 opposite the pinch seal 7, the lamp vessel 6 is closed off by fuse-sealing. The lamp vessel 6 is thus sealed off from the outside in a hermetically sealtight manner.

The light-emitting element 12 is positioned at a slight angle with respect to the longitudinal axis A in the bulb 6 and is held at its single-coil end 31 remote from the film, in an eyelet 20, which is formed by that end of the wire clip which is remote from the film. The eyelet 20 rests on an end part 19 of the wire clip, which is bent back approximately at right angles to the main body 21 of the wire clip. In this case, the eyelet is coiled from a coil comprising 5 turns of the wire from which the wire clip is manufactured.

The eyelet is in this case aligned along the axis formed by the light-emitting element and is therefore bent back virtually through 90° with respect to the end part.

That end 23 of the wire clip which is near to the film is bent back inwards approximately through 45° towards the longitudinal axis of the lamp and is fastened on the first film 17. As a result, the stability of the entire frame is improved.

That end 24 of the light-emitting element which is close to the film is bent back axially in the region of the second film 17.

Figure 3:
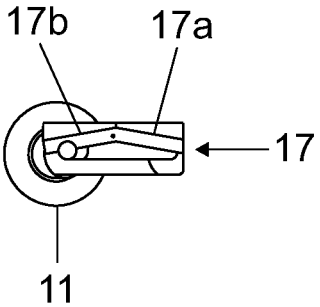
FIG. 3 shows a detail of a film.

FIG. 3 shows a plan view of a film 17 in the direction towards the associated outer power supply line 11. The film is folded in its center in the longitudinal direction, with the result that two film parts 17*a* and 17*b* are inclined in the manner of a roof through approximately 10° with respect to the actual plane of the planar film. As a result, the two film parts 17*a* and 17*b* enclose an angle of 160°.

Figure 4A:
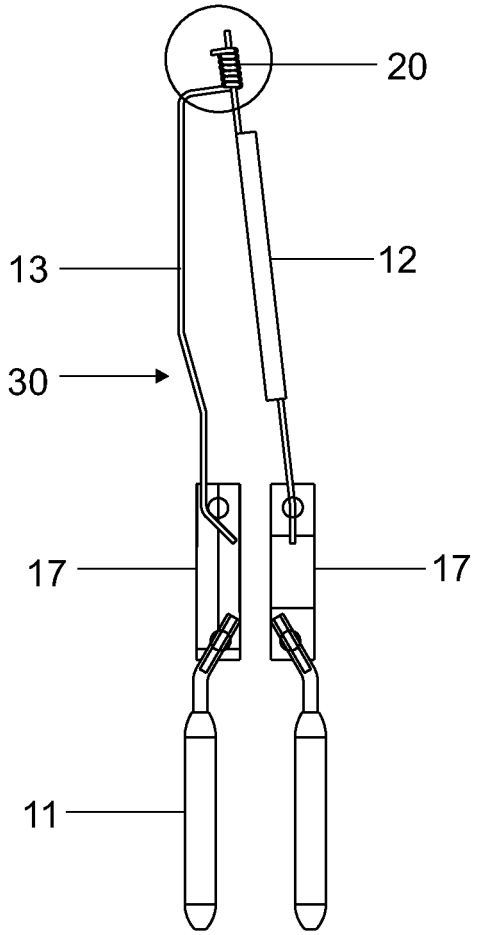
FIG. 4A shows a view of the power supply system.
Figure 4B:
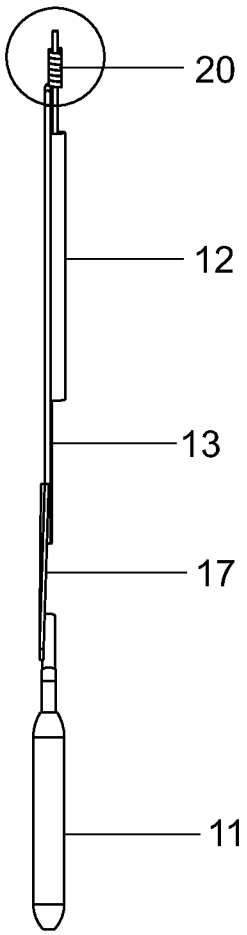
FIG. 4B shows another view of the power supply system of FIG. 4A rotated through 90°.

FIGS. 4A and 4B show two views of the power supply system 30 including light-emitting elements 12. Said figures show clearly that preferably only the first film 17, which is associated with the wire clip 13, is folded in the manner of a roof, while the second film 17 is planar.

Figure 5A:
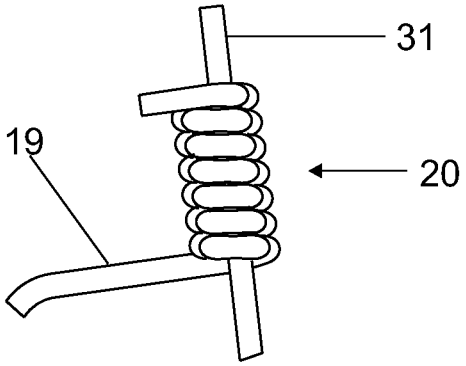
FIG. 5A shows a view of the eyelet in detail.
Figure 5B:
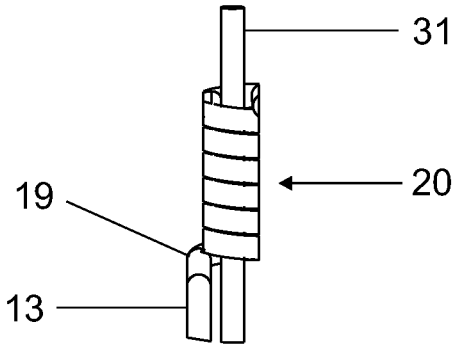
FIG. 5B shows another view of the eyelet of FIG. 5A rotated through 90°.

FIGS. 5A and 5B show a detail with the eyelet 20. That end of the light-emitting element which is remote from the film is passed through the eyelet 20 and clamped in there. During the compression of the eyelet, said eyelet is heated by means of the passage of current. The compressed eyelet 20 is no longer radially symmetrical, as can clearly be seen from FIG. 5A.

What is claimed is:

1. An electric lamp having a longitudinal axis, wherein the electric lamp is provided with a pinch seal; said pinch seal having two narrow sides and two broad sides, and wherein the electric lamp has a bulb consisting of quartz glass equipped with said pinch seal and films fitted therein, in which bulb a light-emitting element is held at the ends of said light-emitting element by a frame, wherein the frame has at least one wire clip, which holds an end of the light-emitting element which is remote from the films, wherein the wire clip is manufactured at least partially from tungsten and is bent back at an angle at a film-side end of said wire clip, and wherein a film associated with the wire clip is folded in the form of a V along the longitudinal axis, and a film associated with the light-emitting element is planar.

2. The electric lamp of claim 1, wherein the folding of the film associated with the wire clip is performed in the center, and wherein the angle of the fold has a value in the range of 5° to 15°.

3. The electric lamp of claim 1, wherein the film-side end of the wire clip is bent back through 30° to 60° with respect to the longitudinal axis.

4. The electric lamp of claim 1, wherein that end of the wire clip which is remote from the films is bent back with respect to the longitudinal axis through an angle of from 75° to 105°.

5. The electric lamp of claim 1, wherein that end of the wire clip which is remote from said films is bent back, wherein an end piece of the wire clip is formed as a coil comprising a plurality of turns, which coil is matched to that end of the light-emitting element which is remote from said films, outwardly as an eyelet.

6. The electric lamp of claim 5, wherein the eyelet is formed from 4 to 8 turns of the coil.

7. The electric lamp of claim 1, wherein the light-emitting element is inclined with respect to the longitudinal axis through 5° to 20°, wherein a film-side end of the light-emitting element is fastened on one of said films in the pinch seal.

8. The electric lamp of claim 1, wherein the electric lamp is configured as built-in lamp which is surrounded by an outer vessel, said outer vessel being fastened to a lamp base.

* * * * *